United States Patent [19]

Evans et al.

[11] Patent Number: 4,553,429

[45] Date of Patent: Nov. 19, 1985

[54] METHOD AND APPARATUS FOR MONITORING FLUID FLOW BETWEEN A BOREHOLE AND THE SURROUNDING FORMATIONS IN THE COURSE OF DRILLING OPERATIONS

[75] Inventors: John L. Evans; George F. Gehrig; Jerry M. Speers, all of Houston, Tex.

[73] Assignee: Exxon Production Research Co., Houston, Tex.

[21] Appl. No.: 578,721

[22] Filed: Feb. 9, 1984

[51] Int. Cl.[4] ..... E21B 49/00

[52] U.S. Cl. ..... 73/155

[58] Field of Search ..... 73/155, 153; 175/7, 175/27

[56] References Cited

U.S. PATENT DOCUMENTS

| | | | |
|---|---|---|---|
| 3,602,322 | 8/1971 | Gorsuch | 175/48 |
| 3,729,986 | 5/1973 | Leonard | 73/155 |
| 3,809,170 | 5/1974 | Ilfrey et al. | 175/7 |
| 3,833,076 | 9/1974 | Griffin, III | 73/155 |
| 3,899,926 | 8/1975 | Haden | 73/153 |
| 3,910,110 | 10/1975 | Jefferies et al. | 73/155 |
| 3,942,594 | 3/1976 | Smith et al. | 175/27 |
| 3,976,148 | 8/1976 | Maus et al. | 175/7 |
| 4,110,688 | 8/1978 | Bailey | 324/208 |
| 4,282,939 | 8/1981 | Maus et al. | 175/7 |

OTHER PUBLICATIONS

U.S. Patent Application Serial No. 306,252, filed Sep. 24, 1981, Assignee: Exxon Production Research Company.

*Primary Examiner*—Jerry W. Myracle

*Attorney, Agent, or Firm*—Richard F. Phillips

[57] ABSTRACT

A method and apparatus for establishing the rate at which fluid is transferred between a borehole 14 and the surrounding formations 16 in the course of moving drill string 20 upward or downward in the borehole 14. A bell nipple 40 is situated at the upper portion of the borehole 14. While tripping, drilling fluid is circulated into the borehole 14 and exits through an outflow port 44 in the bell nipple 40. The level of drilling fluid is maintained constant at the outflow port 44. Meters 52, 52′, 54 are provided to measure inflow and outflow rates. Circuitry 66 is provided to establish the volume rate at which the amount of drill string 20 within the borehole 14 changes. The outputs of the meters 52, 52′, 54 and rate establishing means 66 are summed to establish the compensated rate at which fluid is transferred between the formations 16 and the borehole 14. This compensated rate is compared to an alarm limit. An alarm 76 is activated if the compensated rate exceeds the alarm limit.

14 Claims, 4 Drawing Figures

METHOD AND APPARATUS FOR MONITORING FLUID FLOW BETWEEN A BOREHOLE AND THE SURROUNDING FORMATIONS IN THE COURSE OF DRILLING OPERATIONS

FIELD OF THE INVENTION

This invention relates generally to a method and apparatus useful in the control of a well during the drilling of the well. More particularly, this invention concerns a method and apparatus useful in monitoring the transfer of fluid between a borehole and the formations surrounding the borehole which provides accurate results during normal drilling ahead and also during tripping and other operations in which the drill string is moved up or down within the borehole.

BACKGROUND OF THE INVENTION

In rotary drilling operations a drill bit connected to a drill string is used to establish a borehole in the earth. The drill string is supported and powered by a drilling rig located at the earth's surface, or, in the case of offshore drilling, on a drillship or marine platform. The drill string is composed of sections of pipe which are joined at threaded connections. Immediately above the drill bit the drill string includes several drill collars, which are heavy-walled tubular elements adding weight to the drill bit to improve its performance. The remainder of the drill string, extending upward from the drill collars to the surface, is composed of drill pipe.

From time to time in the course of drilling operations, drilling is stopped and the drill string is pulled away from the bottom of the borehole. Most frequently, this is done for the purpose of adding an additional length of drill pipe. This involves lifting the drill string a short distance to bring the uppermost point in the drill string, the connection between the kelly and the drill string, to a location just above the rig floor. This lifting of the drill string also occurs during temporary cessations in drilling operations, when the drill string is repeatedly lifted and lowered a short distance within the borehole to prevent differential sticking of the drill string against the wall of the borehole. Periodically during drilling operations, the drill string is entirely withdrawn from the borehole, most commonly for the purpose of changing the bit. Withdrawing the entire drill string from the well is termed "tripping out", reinserting the drill string is termed "tripping in".

As the drill string is rotated by the drilling rig to cause the drill bit to cut into the rock, drilling fluid, commonly referred to as mud, is pumped to the drill bit through the tubular drill string. The drilling fluid passes into the borehole through nozzles in the drill bit and then flows back to the surface through that portion of the borehole outside the drill string, termed the annulus. The drilling fluid is quite important in the drilling operation, serving to cool and lubricate the drill bit, to carry cuttings away from the bottom of the borehole, to support the walls of the borehole and to minimize the pressure differential between the borehole and the surrounding formations.

As the drill bit penetrates a subterranean formation, that formation is brought into fluid communication with the surface via the borehole. If the pressure of the formation exceeds that of the borehole, the fluids in the formation (most typically water, oil or gas) can be forced into the borehole under pressure and released to the surface in an uncontrolled manner. This condition is commonly termed a blowout. To prevent this, the density of the drilling fluid is carefully controlled to maintain the pressure in the borehole at a level such that the fluids in permeable formations are not forced into the borehole.

Well control problems can also arise if the pressure in the borehole significantly exceeds that of any formations traversed by the borehole. Should the density of the drilling fluid be greater than that of a permeable formation, it is possible for drilling fluid to be forced into the formation. This condition is termed lost returns. In some instances the hydrostatic pressure of the drilling fluid can be great enough to fracture a weak formation, causing drilling fluid to be lost into the formation at a rapid rate. Should there also be a relatively high pressure formation at some other point along the borehole, this loss of drilling fluid to the weak formation can cause a drop in hydrostatic pressure head in the borehole of sufficient magnitude to induce a blowout from the high pressure formation. To minimize the potential for lost returns, it is usually desired to control the density of the drilling fluid such that the pressure in the borehole does not greatly exceed that of the permeable weak formations.

The most effective manner of guarding against blowouts is to monitor the well to determine the onset of formation fluid intrusion. If this initial intrusion, commonly referred to as a kick, is detected at its inception it is usually not difficult to prevent the situation from advancing to a blowout. Similarly, lost circulation is most easily corrected when the loss of drilling fluid is detected at an early stage.

A well known technique for detecting kicks and lost circulation in the course of drilling is delta flow monitoring. This method involves comparing the flow rate of drilling fluid injected into the well at the surface to the rate at which drilling fluid exits the well at the surface. After averaging these rates over a suitable time period, it becomes possible to determine the differential flow rate commonly referred to as the "delta flow rate". This represents the cumulative change in the amount of the drilling fluid within the well. A net addition of drilling fluid to the borehole is indicative of lost returns. Likewise, an excess of returned drilling fluid over injected drilling fluid signals a potential blowout. Upon receipt of an indication of such well control problems, remedial measures may be initiated. These remedial measures are usually designed to lessen the pressure differential between the borehole and the surrounding formations, or to seal the permeable formations through which fluid migration is occurring.

Well control problems occur with relatively great frequency in the course of tripping, adding a stand of drill pipe to the drill string, reciprocation, and other operations in which the drill bit is moved to and from the bottom of the borehole. Such problems are thought to result from borehole pressure transients induced by the swabbing and plunging action established by relatively rapid withdrawal and insertion of the drill string in the borehole. Well control problems in the course of such drill string movement have typically been monitored with various modified delta flow comparison techniques.

The most basic prior art techniques of delta flow monitoring assume that the volume of that portion of the borehole and associated drilling equipment which can be occupied by drilling fluid is constant. This assumption is generally satisfactory where the rate of drill string movement into or out of the borehole is negligible, as is generally the case in normal drilling ahead. However, to establish adequate accuracy in delta flow monitoring techniques utilized in the course of tripping and other phases of the drilling operation in which the rate of movement of the drill string is significant, it is necessary to account for these changes in volume.

Prior art techniques of accomplishing such compensation are largely directed to tripping, ignoring other situations in which the drill string is lifted and lowered within the borehole. Such prior art techniques generally provide some manual means of correcting for the changing volume of drill string within the borehole. In one commonly utilized technique, drilling fluid is circulated from a trip tank into the borehole and drilling fluid exiting the borehole is returned to the trip tank. The fluid level within this trip tank is manually checked every seven to ten stands of drill pipe. The level of drilling fluid within the trip tank should increase approximately one barrel per stand tripping in. While tripping out the level should decrease by a like amount. A difference between the anticipated and actual changes in the drilling fluid level represents of a net transfer of fluid between the formation and the borehole.

A related technique for monitoring delta flow in the course of tripping is disclosed in U.S. Pat. No. 3,729,986, issued May 1, 1973. The volume of each segment of the drill string is known, After a given number of segments have been tripped in or out, the total equivalent volume of these stands is compared to the volume of drilling fluid that must be added or removed to bring the drilling fluid back to the reference level in the bell nipple which it occupied prior to tripping the stands. Any difference between the volume of the stands and the change in volume of the fluid represents a net transfer of fluid between the formation and the borehole. Such systems are disadvantageous in that there is often a significant delay between the onset of a well control problem and the detection of that problem.

SUMMARY OF THE INVENTION

A delta flow monitoring method is set forth which is especially useful for determining the existence of well control problems occurring in the course of moving drill string into or out of a borehole. This method is useful in situations in which the total movement is only a few meters, as in adding or removing a joint of drill pipe to or from the drill string, and also in situations in which the total movement is great, as in tripping in or out an entire stand of drill pipe. The level of the drilling fluid is maintained at a fixed reference level. The rates at which drilling fluid is injected into and removed from the borehole to maintain the drilling fluid at this reference level are automatically monitored. The rate of change of the volume of drill string within the borehole is also monitored. The inflow and outflow rates for the drilling fluid are summed to establish the volume rate of change of fluid within the borehole. This is added to the volume rate at which the drilling fluid capacity of the borehole and associated surface drilling equipment changes due to upward or downward motion of the drill string. The result represents the rate at which fluid flow is occurring between the formation and the borehole. An alarm can be activated in response to the result exceeding a selected value. Apparatus for practicing this method is also disclosed.

BRIEF DESCRIPTION OF THE DRAWINGS

For a better understanding of the present invention, reference may be had to accompanying drawings, in which.

These drawings are not intended as a definition of the invention but are provided solely for the purpose of illustrating certain preferred embodiment of the invention described below.

Figure 1:
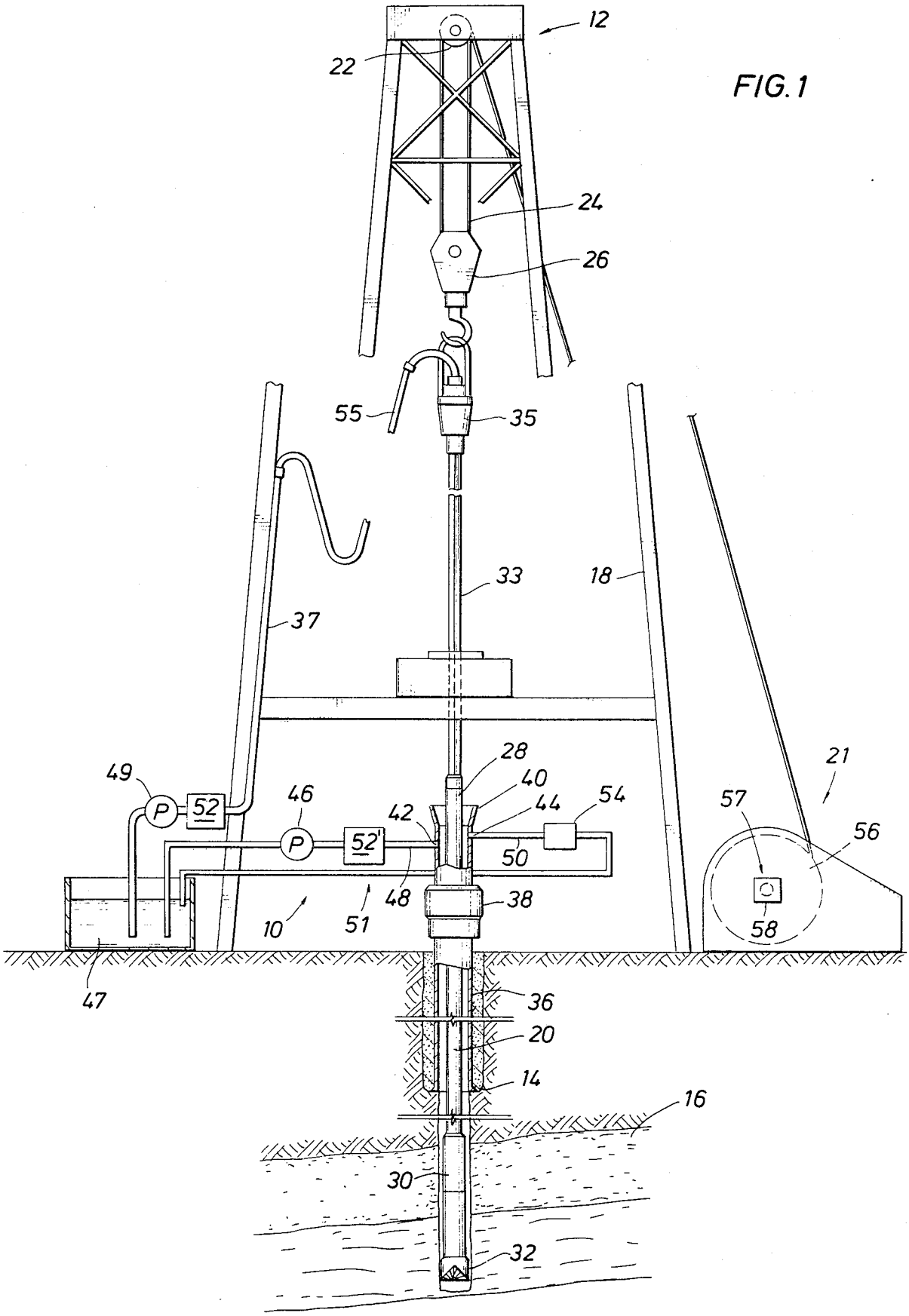
FIG. 1 shows an elevational view, partly in schematic, of a drilling rig incorporating an embodiment of the present invention, the drilling rig being shown in condition for drilling ahead.
Figure 2:
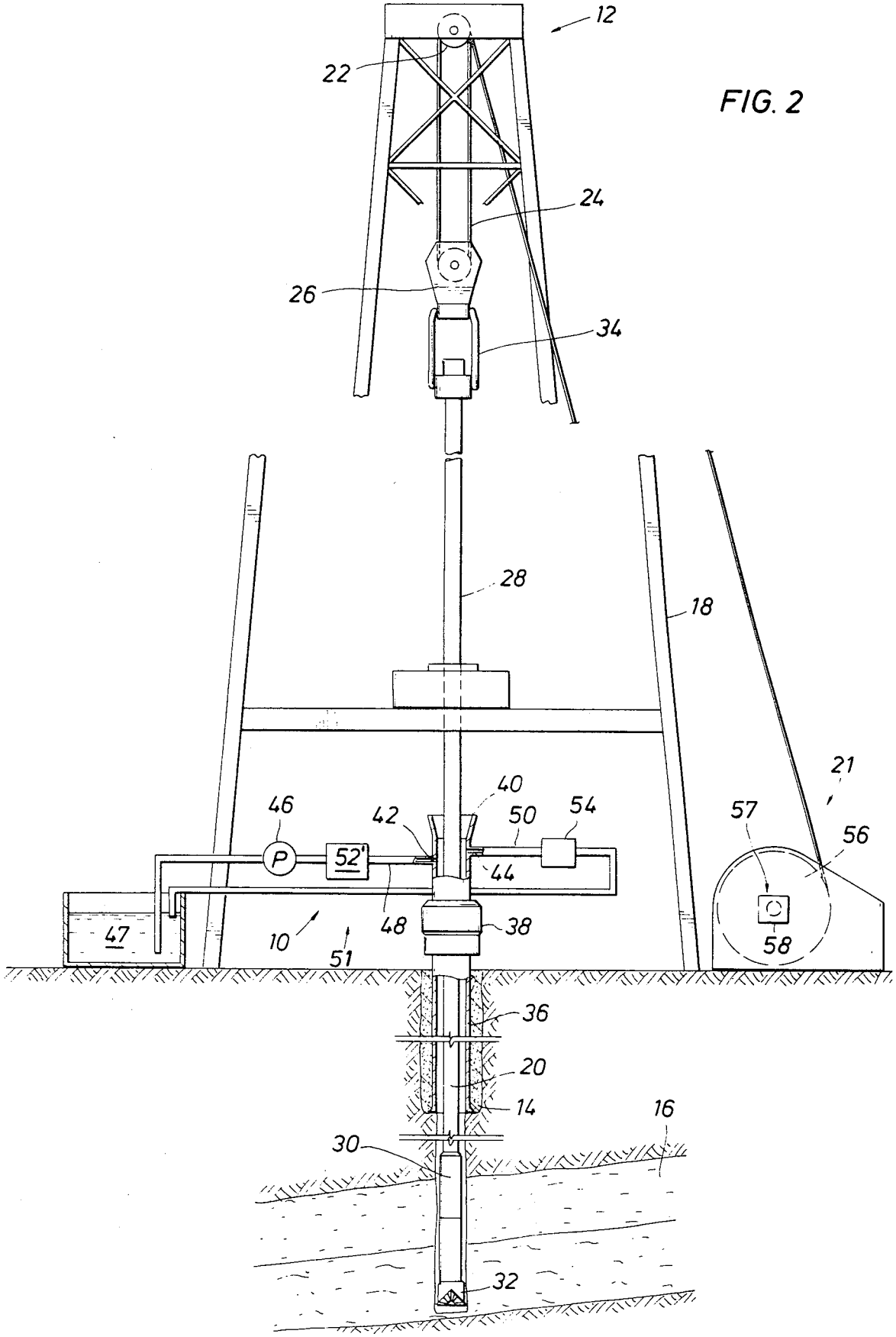
FIG. 2 shows an elevational view, partly in schematic, of a drilling rig incorporating an embodiment of the present invention, the drilling rig being shown in the course of tripping the drill string—for the purpose of clarity those portions of the drilling and mud handling equipment not required in the course of tripping have been omitted.

DESCRIPTION OF THE PREFERRED EMBODIMENTS i. Relevant mechanical components involved in drilling operations Diagrammatically illustrated in FIGS. 1 and 2 is a preferred embodiment of the mechanical and electromechanical components of the delta flow monitoring apparatus of the present invention. The delta flow monitoring apparatus is generally indicated therein by the reference numeral 10. The delta flow monitoring apparatus 10 is associated with a drilling rig 12 and serves to monitor fluid flow between a borehole 14 and the subterranean formations 16 surrounding the borehole 14. The delta flow monitoring apparatus 10 yields delta flow measurements of drilling fluid flow. These delta flow measurements are used to detect abnormal circulation situations occurring in drilling operations. FIG. 1 shows the delta flow monitoring apparatus 10 used in a rig 12 configured for receiving drilling fluid injection through the drill string. FIG. 2 shows the delta flow monitoring apparatus 10 used in a rig 12 configured for receiving drilling fluid inflow through a bell nipple, as would most commonly occur in the course of tripping.

As shown in FIGS. 1 and 2, the drilling rig 12 includes a derrick 18 which supports a drill string 20 extending into the borehole 14. Drawworks 21 are provided for raising and lowering the drill string 20. A crown block 22 is fixedly attached to the top of the derrick 18. Drilling cable 24 is reeved around the crown block 22 and extends downward to a traveling block 26 which supports the drill string 20. One end of the drilling cable 24 extends down to the drawworks 21. The drawworks 21 are used to reel the drilling cable 24 in and out. This causes the traveling block 26 to move upward or downward, resulting in vertical movement of the drill string 20 within the borehole 14. In FIGS. 1 and 2, the drilling rig 12 is shown in the process of raising the drill string 20 off bottom.

The drill string 20 is primarily composed of drill pipe 28 but also includes a plurality of thick-walled drill collars 30 forming that portion of the drill string 20 immediately above the drill bit 32. In normal drilling operations the drill string 20 is connected to the traveling block 26 by a kelly 33 and swivel 35, as shown in FIG. 1. In the course of tripping, the drill string 20 is connected directly to the traveling block 26 by elevators 34. This is shown in FIG. 2. In both situations the traveling block 26 and drill string 20 move upward and downward as a unit; that is, as the traveling block 26 is moved a certain distance by the drawworks 21, the drill string 20 moves a like distance. Accordingly, translational motion of the drill string 20 can be monitored by monitoring the position of the traveling block 26.

The upper portion of the borehole 14 is lined with surface casing 36, which extends upward to a blowout preventer 38. Positioned atop the blowout preventer 38 is a bell nipple 40. The bell nipple 40 serves to guide the drill bit 32 into the borehole 14 at the commencement of tripping in. The bell nipple 40 is also important to the drilling fluid handling system, as well be described subsequently.

Tripping out is commenced by moving the traveling block 26 upward until the joint between the kelly 33 and first section of drill pipe 28 is above the rig floor. The drill pipe 28 is then locked to the rig floor and the connection between the kelly 33 and drill pipe 28 is broken out and the kelly 33 and swivel 35 are set aside. The traveling block 26 is then lowered toward the rig floor and the elevators 34 are locked to the uppermost section of drill pipe 28. The traveling block 26 is moved upward until the first stand of drill pipe 28 is fully above the rig floor. The drill pipe 28 is again locked to the rig floor and the first stand of drill pipe 28 is broken out from the remainder of the drill string 20. The first stand of drill pipe 28 is set aside, the traveling block 26 is lowered toward the rig floor and affixed to the top of the second stand of drill pipe 28. The drill string 20 is again raised until the second stand of drill pipe 28 is exposed and can be detached. The process is repeated until the drill string 20 is fully removed. Tripping in is the reverse of this process.

ii. Relevant aspects of drilling fluid handling

It is important to the present invention that the drilling fluid within the annulus outside the drill string 20 be maintained at a substantially constant reference level. This facilitates the delta flow measurements basic to the practice of the present invention, as will be described in greater detail below. Further, maintaining a constant drilling fluid level outside the drill string 20 also assists in establishing a relatively constant downhole pressure, simplifying the process of well control.

Broadly, maintaining this constant level is attained by establishing a fluid removal point at a selected point in the upper portion of the borehole 14, beyond which the level of drilling fluid cannot rise. Drilling fluid is pumped into the borehole 14 at a rate great enough to prevent the level of drilling fluid from falling below this selected removal point. In the preferred embodiment, this fluid removal point is located in the bell nipple 40. The bell nipple 40 has an inflow port 42 and outflow port 44. As the level of the drilling fluid reaches the outflow port 44, it is removed through an outflow line to a drilling fluid storage area 47, which may be a mud pit or tank. Preferably, the outflow of drilling fluid occurs by gravity flow, as shown in FIGS. 1 and 2. A pump (not shown) can be used to facilitate return of drilling fluid from the outflow port 44 to the drilling fluid storage area 47.

In the course of drilling ahead and other operations in which the kelly 33 is attached to the drill string 20, as shown in FIG. 1, drilling fluid circulation into the borehole 14 occurs through the drill string 20. A mud pump 49 pumps drilling fluid from the drilling fluid storage area 47 into a standpipe 37, from which it passes into the kelly hose 55, and then into the swivel 35 to the kelly 33, and then through the drill string 20 to the drill bit 32. Return is upward through the annulus outside the drill string 20 to the bell nipple outflow port 44 and then through the outflow line 50 to the drilling fluid storage area 47.

FIG. 2 illustrates the rig 12 and associated equipment in the course of tripping the drill string 20. Drilling fluid is not circulated through the drill string 20 in the course of tripping. A tripping pump 46 injects drilling fluid from the drilling fluid storage fluid storage area 47 through an inflow line 48 to the inflow port 42 of the bell nipple 40. Return occurs through the outflow port 44, in the same manner as for injection through the drill string 20. In the practice of the present invention, it is preferable to inject drilling fluid at a rate sufficient to maintain drilling fluid at the level of the outflow port 44. Accordingly, it is preferable to inject drilling fluid at a rate at least equivalent to the greatest anticipated volume rate of drill string withdrawal. In the course of tripping in it may not be necessary to inject drilling fluid through the inflow port 42 because the rate at which drill string 20 is added to the borehole 14 generally exceeds the rate of loss of drilling fluid to the formation 16.

The drilling fluid storage area 47, pumps 46, 49, inflow line 48, standpipe 37, kelly hose 55, kelly 33, that portion of the drill string 20 above the bell nipple 40, and outflow line 50 form a drilling fluid handling system 51 for transferring drilling fluid to and from the borehole 14. The drilling fluid transferring means 51 and bell nipple 40 form portions of means 53 for maintaining the drilling fluid at a constant reference level in the borehole 14. For the purposes of the present description and the appended claims, the borehole 14 will be deemed to include the open hole, the internal volume of the casing 36, the blowout preventer 38 and that portion of the bell nipple 40 below the outflow port 44.

iii. Delta Flow Compensation For Drill String Movement

In the practice of the preferred embodiment of the present invention it is necessary to establish: (1) the rate at which drilling fluid is added to the borehole; (2) the rate at which drilling fluid is withdrawn from the borehole; (3) the rate at which the fluid capacity of the borehole 14 changes due to insertion or withdrawal of the drill string 20; and, (4) the rate of change, if any, in the fluid capacity of any portion of the drilling fluid transferring means 51 intermediate the points at which measurement of drilling fluid injection and withdrawal rates are made. The sum of these four rates is equal to the rate at which drilling fluid is transferred between the borehole 14 and surrounding formations 16. As described below, the measurement of items 3 and 4 above can be combined. As previously described, in the course of tripping, drilling fluid injection takes place in a drilling fluid handling system 51 of fixed internal volume; accordingly, the fourth item listed above is not a factor in tripping. However, this is not the case for operations in which drilling fluid injection occurs through the drill string 20, because the volume of that portion of the kelly 33 and drill string 20 external to the borehole 14 is variable. For such operations the compensation established by the fourth item is quite significant, amounting to several liters per meter of drill string travel.

An inflow meter 52 for monitoring the rate at which drilling fluid is pumped into the drill string 20 is positioned in the line intermediate the mud pump 49 and kelly hose 55. A corresponding tripping inflow flow meter 52' is positioned in the tripping inflow line 48. An outflow flow meter 54 is positioned in the outflow line 50. The flow meters 52, 52', 54 are adapted to generate output signals corresponding to the detected flow rate. Because drilling fluid is not simultaneously circulated into both the drill string 20 and the bell nipple 40, no more than one of the two inflow flow meters 52, 52' will be active at any given time. Preferably the flow meters 52, 52', 54 are magnetic flow meters, such as Model 10D1435 A/U manufactured by Fisher and Porter. The measurement made by such flow meters is based on the voltage induced by the flow of drilling fluid past a strong magnetic field. Such flow meters are well suited for use in the present invention because they establish substantially no restriction to fluid flow and are resistant to fouling. However, those skilled in the art will recognize other types of flow meters, such as turbine flow meters and sonic flow meters, also suitable for use in the present invention.

In a borehole 14 in which the drill string 20 is stationary and in which there is no net passage of fluid between the formation 16 and the borehole 14, the volume of drilling fluid in the borehole 14 will remain constant. Accordingly, the inflow as detected by the active one of the two inflow flow meters 52, 52' will equal the outflow as detected by the outflow meter 54. Assuming again no net transfer of fluid between the formation 16 and borehole 14, if the drill string 20 is moved upward in the borehole 14, there will be a net inflow of drilling fluid into the borehole 14. In the course of lowering the drill string 20 into the borehole 14, there will be a net outflow of drilling fluid.

The magnitude of the net flow is dependent on whether the drilling fluid is injected into the kelly 33 or the bell nipple 40. For drilling injection through the drill string 20, movement of the drill string 20 changes not only the fluid capacity of the borehole 14 but also the amount of drilling fluid within that portion of the drill string 20 above the borehole 14. This consideration is of course not relevant where injection occurs into the bell nipple 40, bypassing the drill string 20.

In view of the foregoing, the net fluid flow as detected by the inflow flow meters 52, 52' and the outflow flow meter 54 may be precisely stated for the special situation in which no net flow occurs between the formation and borehole 14. Where drilling fluid inflow occurs through the bell nipple 40, the magnitude of the net drilling fluid flow is substantially equal to the displacement volume (that is, the volume excluding the volume of the hollow internal portion) of that portion of the drill string 20 removed from or inserted into the borehole 14. For the situation in which drilling fluid inflow occurs through the drill string 20, it is necessary to account both for the displacement volume of drill string 20 removed from or inserted into the bell nipple 40 and for changes in the amount of drilling fluid in that portion of the kelly 33 and drill string 20 external to the borehole 14. The total volume change is equivalent to the total volume of drill string 20 and kelly 33, including the hollow internal portion, which traverses the bell nipple 40.

In the preferred embodiment of the present invention, the kelly 33 and drill string 20 are assumed to have the same displacement volume and internal volume per unit length. This, of course, does not perfectly reflect the true situation in most applications, but is a useful simplifying approximation. However, in two of the most critical operations from the standpoint of well control—reciprocation and tripping—this approximation results in little or no error because the kelly 33-drill string 20 connection rarely traverses the bell nipple outflow port 44.

It has been discovered that in the course of moving the drill string 20 rapidly into the borehole 14, as occurs in tripping, the level of the drilling fluid within the drill string 20 occasionally falls temporarily below the level of drilling fluid within the bell nipple 40. This is generally caused when the drilling fluid within the borehole 14 contains large amounts of cuttings, causing the jets of the drill bit 32 to partially clog. This limits the rate of drilling fluid flow into the drill string 20 as the drill string 20 is inserted into the borehole 14. As a result, the level of drilling fluid within the drill string 20 remains below the level of the bell nipple outflow port 44. This difference in fluid level can cause some inaccuracy in compensating for volume changes attributable to insertion of the drill string 20 during tripping. However, even in those situations in which this problem occurs, the present invention yields results more accurate than prior art uncompensated or delayed compensation techniques.

Another situation causing net drilling fluid flow to differ from volume changes caused by drill string movement results from drilling fluid adhering to that portion of the drill string 20 which is withdrawn from the bell nipple 40. A portion of this drilling fluid does not fall back into the bell nipple, but is lost as spray or remains on the drill pipe 28. The amount of the drilling fluid that is lost from the system in this manner is generally small and is dependent primarily on the rate of withdrawal of the drill string 20, atmospheric conditions, and viscosity of the drilling fluid. This loss of drilling fluid may be kept very low through the use of a drill string wiper (not shown). Where especially accurate results are required, correction for this "lost" drilling fluid may be desired by including in the delta flow calculation a factor to account for this lost fluid.

In drilling operations it is often the case that there is a net transfer of fluid between the borehole 14 and the surrounding formations 16. The magnitude of this net transfer is a measure of well control problems occurring in the course of drilling operations. Where there is fluid transfer between the formation 16 and the borehole 14, the change in volume of drilling fluid within the borehole 14 resulting from movement of the drill string 20 will not correspond to the net volume rate at which drilling fluid is added or withdrawn to the borehole 14. The difference between these two rates is a measure of the rate at which fluid passes between the formations 16 and the borehole 14. It is this difference that the present invention is intended to monitor.

iv. Monitoring Drill String Movement

Means 66 are provided for establishing a volume compensation factor to account for drill string motion. As previously discussed, this volume compensation factor is dependent on whether inflow occurs through the bell nipple 40 or the drill string 20. As will be described subsequently in greater detail, selection of the correct one of the two factors is accomplished by monitoring the two inflow meters 52, 52' to detect which is receiving fluid flow.

The compensation factor to apply to the observed net surface flow rate to correct for drill string movement during any time period is established by multiplying the drill string travel in that time period by the amount of drilling fluid required to compensate for that drill string travel. As previously discussed, drill string travel is equal to traveling block travel. Means 57 for monitoring the rate of drill string movement is provided. In the preferred embodiment, movement of the traveling block 26 is monitored by detecting the rate of angular rotation of the drawworks drum 56. A simple algebraic relationship correlates the number of turns of the drawworks drum 56 to movement of the drill string 20: $L=\theta D/2N$, where L is length of drill pipe withdrawn or inserted, $\theta$ is the rotation of the drawworks drum in radians, D is the mean diameter of the drawworks drum 56, and N is the number of lines on the traveling block 26. The angular rotation of the drawworks drum 56 is preferably monitored with a shaft encoder 58.

In an alternative embodiment, the rate at which drilling cable 24 moves past a selected point intermediate the drawworks 21 and the crown block 22 is monitored and converted into equivalent travel of the drill string 20. This movement can be achieved through use of a cable travel monitoring device, which can be of the variety which measures the passage of magnetic marks of fixed spacing, or a capstan and metered wheel variety, or some other device as would be familiar to those skilled in the art. To convert movement of the drilling cable 24 into equivalent movement of the drill string 20, it is necessary to divide the distance traversed by the drilling cable 24 by the number of lines on the traveling block 26.

The rate of movement of the traveling block 26 corresponds to the rate of movement of the drill string 20. The volume rate at which the amount of drill string 20 within the borehole 14 changes is established by multiplying the rate of movement of the drill string 20 by the appropriate cross sectional area of the drill string 20. Generally, this cross sectional area is substantially constant for the drill pipe 28, representing most of the length of the drill string 20. In tripping, it is not critical to account for the drill collars 30, which have a significantly greater cross-sectional area than does the drill pipe 28. The drill collars 30 generally represent only the bottom 100–400 meters of the drill string 20. Typically, the upper, cased portion of the well is of significantly greater diameter than is the lower, open hole section of the borehole 14. Accordingly, there is little chance of swabbing in a kick or initiating lost circulation as the drill collars traverse the bell nipple 40. Further, the period of time during which the drill collars 30 are withdrawn from or inserted into the bell nipple 40 is small relative to that for the drill pipe 28.

As an alternative to utilizing movement of the traveling block 26 in establishing the rate of movement of the drill string 20, the drill string 20 can be monitored directly. This can be accomplished with a calibrated measuring wheel (not shown) biased against the drill string 20, adapted to provide a signal proportional to the rate at which drill string passes it. The calibrated measuring wheel is preferably mounted intermediate the bell nipple 40 and the floor of the drilling rig 10.

v. Delta Flow Electronics

Figure 3:
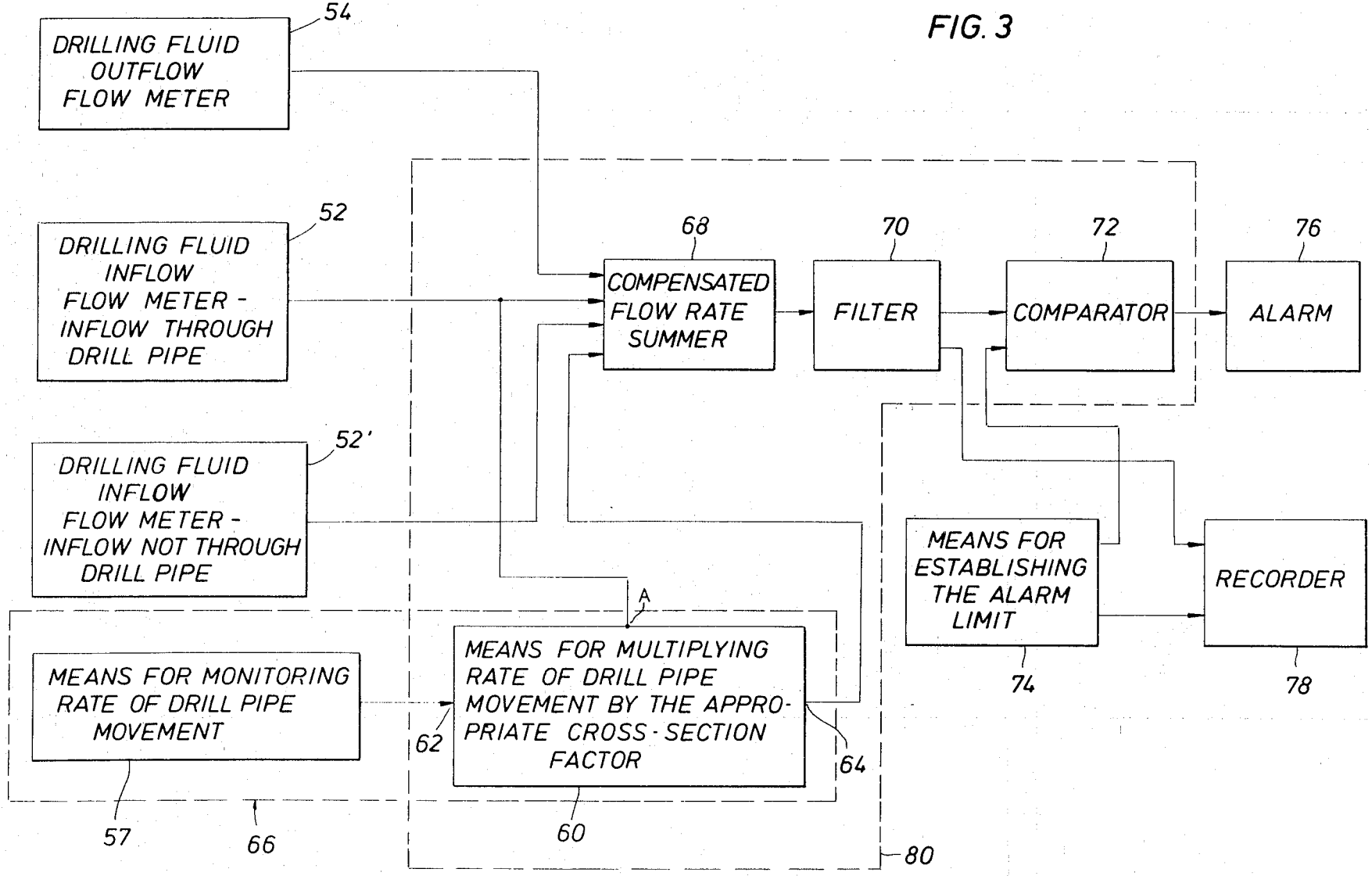
FIG. 3 shows a block diagram of an electrical system suitable for use in the present invention.

Diagramatically illustrated in FIG. 3 are the electrical components of a preferred embodiment of the present invention. As previously discussed, it is necessary to convert travel of the drill string 20 into a compensation factor accounting for the net drilling fluid flow required to account for this travel. This compensation factor is established by multiplying drill string travel by a constant. This constant is the cross sectional area of the drill string walls for situations in which drilling fluid is added through the bell nipple 40, and is the total cross sectional area of the drill string 20, including the central hollow portion, where the drilling fluid is injected through the drill string 20. The outputs of the two inflow flow meters 52, 52' and means 57 for monitoring drill string travel are provided to means 60 for multiplying the rate of drill string movement by the appropriate cross section factor. The appropriate cross section is selected by detecting whether drilling fluid is being injected through the drill string 20. Preferably, the multiplying means 60 is a bi-constant multiplier having a multiplicand input 62, an output 64 and a constant selector input A. The constant selector input A receives the output of the drill pipe inflow flow meter 52. In response to receiving an input at A, the multiplying means 60 selects the total cross section of the drill string 20 as the constant. In response to the absence of an input at A, the mutiplying means 60 selects the cross sectional area of the drill string walls as the constant. Together, the drill string travel monitoring means 57 and the multiplying means 60 form means 66 for establishing the compensation volume resulting from drill string travel.

The outputs of the flow meters 52, 52', 54 and of the compensation means 66 is provided to a summer 68. The summer 68 establishes the net compensated flow rate of drilling fluid into the bell nipple 40. The conventions assumed in the preferred embodiment are: the output of the inflow flow meters 52, 52' are negative values; the output of the outlfow flow meter 54 is a positive value; and, the output of the compensation means 66 is negative when the drill string 20 is moving downward and positive when the drill string is moving upward. There are only three active inputs to the summer 68 at a given time, since only one of the two inflow flow meters 52, 52' will provide an output at a time.

As stated previously, the sum of the three active inputs to the summer 68 will be zero for the situation in which there is no net transfer of fluid between the formations 16 and the borehole 14. Where there is a net transfer of fluid, the output of the summer 68 will not be zero. An output from the summer 68 of a negative magnitude indicates that drilling fluid is being lost to the formations 16 at a rate equal to the magnitude indicated. An output of positive magnitude represents an intrusion of formation fluid into the borehole 14.

The output of the summer 68 is provided to an averaging filter 70. The filter 70 serves to time-average the summer output. This mitigates the effects of anomolies resulting from cyclical variations in the output of the mud pump 46 and similar periodic fluctuations. The averaging period of the filter is preferably in the range of 30–60 seconds for land and offshore platform operations and in the range of 120–240 seconds for offshore floating operations.

The output of the filter 70 is provided to a comparator 72. The comparator 72 compares the filtered output of the summer 68 to a preselected value. The preselected value is input to the comparator from means 74 for establishing the alarm limit. If the filtered output of the summer 68 exceeds the preselected value, then an alarm 76 is activated. In the preferred embodiment the means 74 for establishing the alarm limit includes a keyboard through which an operator can input an alarm limit appropriate for conditions.

In an alternative embodiment, the means 74 for establishing the alarm limit is adapted to automatically establish the alarm limit. Such a system is advantageous for those circumstances in which it is desired to continuously update the sensitivity of the monitoring apparatus 12 to account for changes in those variables on which the alarm limit is based. Such factors include the amount of drill string 20 within the borehole 14, the rate of movement of the drill string 20, characteristics of the drilling fluid and whether the drill string 20 is being tripped or merely reciprocated. Such automatic alarm limit establishing means 74 receives suitable inputs, as for example from the drill string monitoring means 57, and updates and inputs the comparison value utilized by the comparator 72.

The alarm 76 is activated automatically upon the filtered output of the summer 68 exceeding the alarm limit. In the preferred embodiment, the alarm 76 includes both visual and audible alerts situated on the driller's drawworks control panel. A recorder 78 is also provided to maintain a visual record of the alarm limit and the filtered output of the compensated flow rate summer 60 as a function of time.

Rather than assuming the form of discrete components, the multiplying means 60, the summer 68, the filter 70 and the comparator 72 could be functions of a processing unit 80, such as a microprocessor, as indicated by dashed lines in FIG. 3. The processing unit 80 receives inputs from the flow meters 52, 52' and 54 and the drill string monitoring means 57, converts the output of the drill string monitoring means 57 into the corresponding compensation flow rate, sums the compensation flow rate with the flow rates as observed by the outflow flow meter 54 and the active one of the two inflow flow meters 52, 52', filters the result and compares it to the alarm limit. With appropriate data inputs, the processing unit 80 can also incorporate the alarm limit establishing means 74.

As will be readily apparent to those skilled in the art, numerous alternative embodiments are possible utilizing the concepts of the present invention. In certain applications, it may be advantageous to use a standard uncompensated delta flow system in all situations except tripping. A compensated delta flow system would be provided for tripping.

Figure 4:
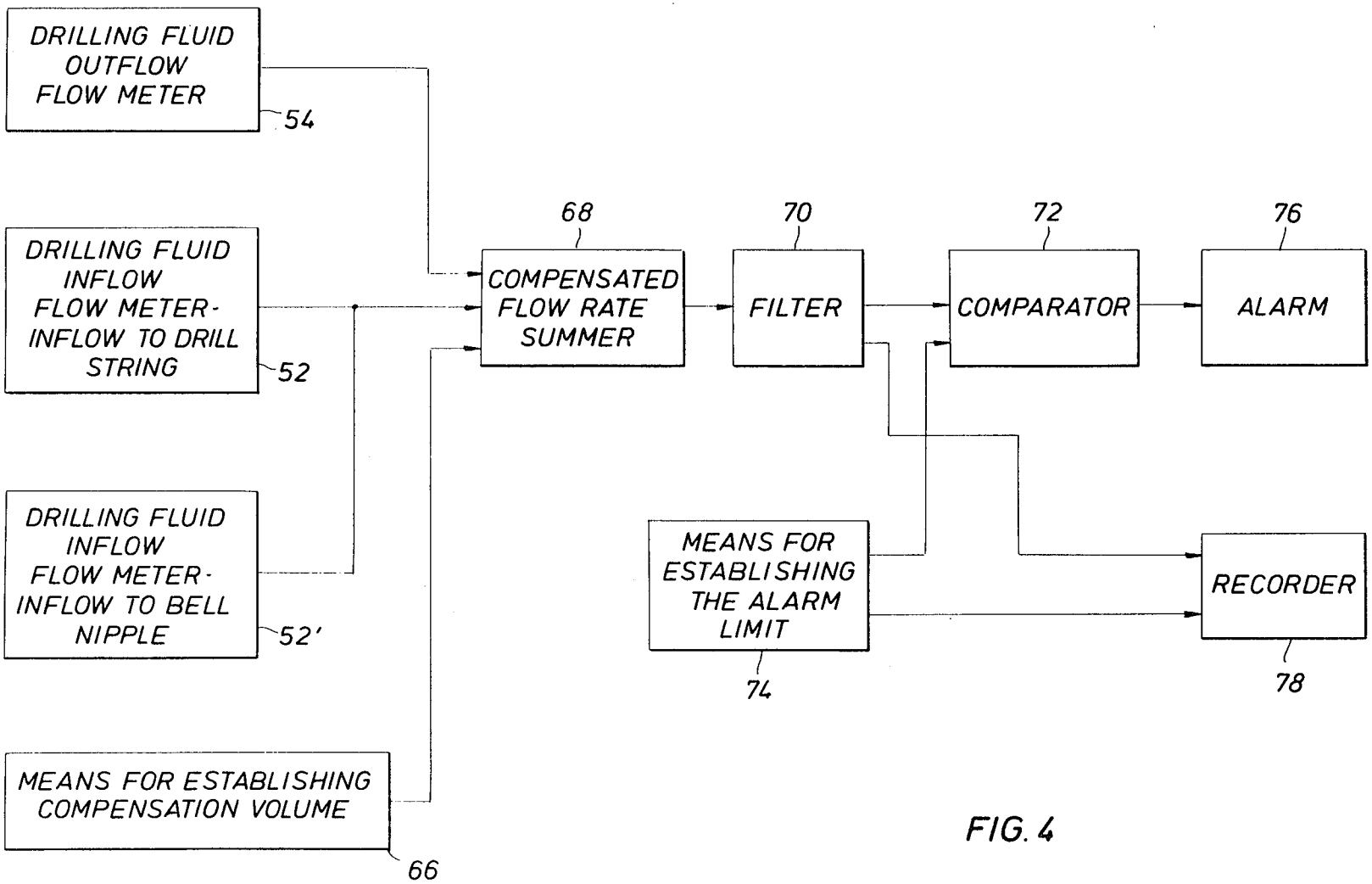
FIG. 4 shows a block diagram of an electrical system suitable for use in an alternate embodiment of the present invention.

In a more simplified embodiment, a drill string motion compensated delta flow system is used in all phases of drilling operations, but the compensation is based exclusively on the displacement volume of the drill string 20. This approach ignores compensation for the internal volume of the drill string 20 for situations in which drilling fluid injection occurs through the drill string 20. This simplifies the electronics, eliminating the need for multiple compensation constraints. The electronics for this simplified embodiment is diagrammatically illustrated in FIG. 4.

The present invention and the best modes of practicing it have been described. It is to be understood that the foregoing description is illustrative only and that other means and techniques can be employed without departing from the true and full scope of the invention as described in the appended claims.

What is clamed is:

1. A method for monitoring fluid flow between a borehole containing drilling fluid and the surrounding subterranean formations in the course of moving a drill string within the borehole, the method comprising the steps of:

transferring drilling fluid between said borehole and a drilling fluid handling system at a rate adequate to maintain the drilling fluid at a substantially constant reference level in said borehole;

generating a first signal representing the rate at which drilling fluid is added to the borehole by the drilling fluid handling system;

generating a second signal representing the rate at which drilling fluid is removed from the borehole to the drilling fluid handling system;

generating a third signal representing the net rate at which the fluid capacity of the borehole changes in response to changes in the length of the drill string within the borehole; and summing the first, second and third signals to obtain a fourth signal substantially representing the rate at which fluid is transferred between the borehole and the formations surrounding the borehole.

2. The method as set forth in claim 1 further including the steps of:

comparing said fourth signal to an established alarm limit; and generating a warning indication in response to said fourth signal exceeding said alarm limit.

3. The method as set forth in claim 1 wherein the step of generating the third signal includes the steps of:

monitoring the rate of movement of the drill string; and converting the rate of movement of the drill string into the corresponding net rate of drilling fluid flow required to compensate for said drill string movement.

4. The method as set forth in claim 1 further including the step of:

averaging the fourth signal over a preselected time period to filter the effect of short term fluctuations in any of the first, second and third signals.

5. The method as set forth in claim 1 wherein the step of generating a third signal includes the steps of:

detecting whether drilling fluid injection is taking place through said drill string; and establishing the third signal $=V\times A$ in response to detecting the existence of drilling fluid injection through the drill string and $=V\times(A\text{-}I)$ in response to detecting the absence of drilling fluid injection through the drill string, where:

$V$ = translational velocity of the drill string;

$A$ = total cross section of the drill string, and;

$I$ = cross section of the hollow central portion of the drill string.

6. A method for monitoring fluid flow between a borehole containing drilling fluid and the surrounding subterranean formations in the course of tripping a drill string within the borehole, the method comprising the steps of:

transferring drilling fluid between said borehole and a drilling fluid handling system, the net rate of said transfer being adequate to maintain the drilling fluid at a substantially constant reference level in said borehole;

generating a first signal representing the rate at which drilling fluid is added to the borehole by the drilling fluid handling system;

generating a second signal representing the rate at which drilling fluid is removed from the borehole to the drilling fluid handling system;

monitoring the rate of movement of the drill string;

converting the rate of movement of the drill string into a third signal representing the rate at which the fluid capacity of the borehole changes in response to changes in the length of the drill string within the borehole;

summing the first, second and third signals to obtain a fourth signal substantially representing the rate at which fluid is transferred between the borehole and the formations surrounding the borehole;

comparing said fourth signal to an established alarm limit; and generating a warning indication in response to said fourth signal exceeding said alarm limit.

7. The method as set forth in claim 6 further including the step of:

averaging the fourth signal over a preselected time period to minimize the effect of short term fluctuations in any of the first, second and third signals.

8. Apparatus for monitoring fluid flow between a borehole containing drilling fluid and the surrounding subterranean formations in the course of moving a drill string within the borehole, said apparatus comprising:

means for maintaining drilling fluid at a substantially constant reference level in said borehole, said level maintaining means including a drilling fluid handling system for transferring drilling fluid between a drilling fluid storage reservoir and said borehole;

an inflow flow meter adapted for establishing a first signal representing the rate at which drilling fluid is added to the borehole by the drilling fluid handling system;

an outflow flow meter adapted for establishing a second signal representing the rate at which drilling fluid is removed from the borehole to the fluid handling system;

means for establishing a third signal representing the rate at which the fluid capacity of the borehole changes in response to changes in the length of drill string within the borehole; and means for summing the first, second and third signals to obtain a fourth signal representing the rate at which fluid is transferred between the borehole and the formations surrounding the borehole.

9. The apparatus as set forth in claim 8 including means for comparing said fourth signal to an established alarm limit and for generating a warning signal in response to the fourth signal exceeding said alarm limit.

10. The apparatus as set forth in claim 8 further including means for averaging the fourth signal over a time period to minimize the effects of rapid fluctuations in the first, second and third signals.

11. The apparatus as set forth in claim 8, said drill string being supported by a traveling block movably suspended from a crown block of a drilling rig by drilling cable, said third signal establishing means including means for monitoring the rate of motion of said drilling cable.

12. The apparatus as set forth in claim 11 wherein said drilling cable is controlled by a drawworks, said means for monitoring the rate of motion of said drilling cable including a shaft encoder mounted on said drawworks.

13. The apparatus as set forth in claim 8 wherein the drilling fluid handling system includes two inflow flow paths, a first flow path adapted for transferring drilling fluid from a drilling fluid reservoir through the drill string to a drill bit through which it passes into a lower portion of the borehole and a second flow path adapted for transferring drilling fluid from the drilling fluid reservoir to an inflow port in the borehole, there being a first flow meter positioned in the first flow path and a second flow meter positioned in the second flow path, the output of the active one of the first and second inflow flow meters providing said first signal.

14. The apparatus as set forth in claim 13 wherein the signal established by the third signal establishing means is proportional to $V \times A$ in response to detecting the existence of drilling fluid injection through the drill string and $= V \times (A - I)$ in response to detecting the absence of drilling fluid injection through the drill string, where:

$V$ = translational velocity of the drill string;

$A$ = total cross section of the drill string, and;

$I$ = cross section of the hollow central portion of the drill string.

* * * * *